US011345972B2

(12) United States Patent
Yamazaki et al.

(10) Patent No.: US 11,345,972 B2
(45) Date of Patent: May 31, 2022

(54) HIGH-STRENGTH HOT-ROLLED STEEL SHEET AND METHOD FOR MANUFACTURING THE SAME

(71) Applicant: JFE STEEL CORPORATION, Tokyo (JP)

(72) Inventors: Kazuhiko Yamazaki, Kawasaki (JP); Kaneharu Okuda, Sendai (JP)

(73) Assignee: JFE Steel Corporation, Tokyo (JP)

( * ) Notice: Subject to any disclaimer, the term of this patent is extended or adjusted under 35 U.S.C. 154(b) by 1318 days.

(21) Appl. No.: 15/121,159

(22) PCT Filed: Feb. 17, 2015

(86) PCT No.: PCT/JP2015/000729

§ 371 (c)(1),
(2) Date: Aug. 24, 2016

(87) PCT Pub. No.: WO2015/129199

PCT Pub. Date: Sep. 3, 2015

(65) Prior Publication Data

US 2017/0009316 A1 Jan. 12, 2017

(30) Foreign Application Priority Data

Feb. 27, 2014 (JP) ..... JP2014-036569

(51) Int. Cl.

| | |
|---|---|
| ***C21D 9/46*** | (2006.01) |
| ***C21D 8/02*** | (2006.01) |
| ***C21D 1/02*** | (2006.01) |
| ***C21D 8/10*** | (2006.01) |
| ***C22C 38/38*** | (2006.01) |
| ***C22C 38/00*** | (2006.01) |

(Continued)

(52) U.S. Cl.

CPC ..... *C21D 9/46* (2013.01); *C21D 1/02* (2013.01); *C21D 1/20* (2013.01); *C21D 8/0221* (2013.01); *C21D 8/0226* (2013.01); *C21D 8/0247* (2013.01); *C21D 8/0263* (2013.01); *C21D 8/105* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/12* (2013.01); *C22C 38/14* (2013.01); *C22C 38/20* (2013.01); *C22C 38/22* (2013.01); *C22C 38/24* (2013.01); *C22C 38/26* (2013.01); *C22C 38/28* (2013.01); *C22C 38/32* (2013.01); *C22C 38/38* (2013.01); *C21D 2211/001* (2013.01); *C21D 2211/002* (2013.01); *C21D 2211/004* (2013.01); *C21D 2211/005* (2013.01); *C21D 2211/008* (2013.01); *C22C 38/42* (2013.01); *C22C 38/50* (2013.01); *C22C 38/54* (2013.01); *C22C 38/58* (2013.01)

(58) Field of Classification Search

CPC ..... C22C 38/06; C22C 38/02; C22C 38/001; C22C 38/12; C22C 38/14; C22C 38/16; C22C 38/08; C22C 38/28; C22C 38/38; C22C 38/005; C22C 38/50; C22C 38/58; C22C 38/26; C22C 38/42; C22C 38/46; C22C 38/32; C22C 38/24; C22C 38/48; C22C 38/22; C22C 38/44; C22C 38/18; C22C 38/54; C22C 38/20; C22C 38/40; C21D 8/02; C21D 8/0263; C21D 8/0226; C21D 8/0205; C21D 8/0426; C21D 8/0463; C21D 8/0247; C21D 8/0473; C21D 8/0273; C21D 8/1222; C21D 8/0221; C21D 6/002; C21D 6/005; C21D 6/008; C21D 6/004; C21D 6/001; C21D 2211/002; C21D 2211/004; C21D 9/46; C21D 9/085; C21D 1/20

USPC ..... 148/330, 332, 333, 602, 331, 320, 336, 148/506, 334, 335, 504, 307, 507, 579; 420/104, 128, 105, 112, 115, 83, 91; 428/684

See application file for complete search history.

(56) References Cited

U.S. PATENT DOCUMENTS

| | | | |
|---|---|---|---|
| 4,219,371 | A | 8/1980 | Nakasugi et al. |
| 6,364,968 | B1 | 4/2002 | Yasuhara et al. |

(Continued)

FOREIGN PATENT DOCUMENTS

| | | | |
|---|---|---|---|
| CA | 2848028 | A1 | 3/2013 |
| CN | 102140608 | A | 8/2011 |

(Continued)

OTHER PUBLICATIONS

Supplementary European Search Report for Application EP 15 75 4845.4, dated Feb. 22, 2017, 31 pages.
Korean Office Action for Korean Application No. 10-2016-7026523, dated Apr. 13, 2018, Office Action, 4 pages.
International Search Report and Written Opinion for International Application PCT/JP2015/000729, dated May 19, 2015, 5 pages.

(Continued)

*Primary Examiner* — Matthew E. Hoban
*Assistant Examiner* — Lynne Edmondson
(74) *Attorney, Agent, or Firm* — RatnerPrestia

(57) ABSTRACT

Provided are a high-strength hot-rolled steel sheet and a method for manufacturing the steel sheet. The steel sheet includes C: 0.060% or more and 0.140% or less, Si: 1.00% or less, Mn: 1.30% or more and 2.50% or less, P: 0.030% or less, S: 0.0050% or less, Al: 0.070% or less, N: 0.010% or less, Ti: 0.060% or more and 0.140% or less, Cr: 0.10% or more and 0.50% or less, B: 0.0002% or more and 0.0020% or less, and the balance being Fe and inevitable impurities, in which the relationship $5.0 \leq 18C+Mn+1.3Cr+1500B \leq 6.0$ is obtained. The microstructure includes a bainite phase in an amount of more than 90% one, two, or all of a ferrite phase, a martensite phase, and a retained austenite phase in an amount of less than 10%.

7 Claims, No Drawings

(51) Int. Cl.

| | |
|---|---|
| ***C22C 38/04*** | (2006.01) |
| ***C22C 38/18*** | (2006.01) |
| ***C22C 38/12*** | (2006.01) |
| ***C22C 38/14*** | (2006.01) |
| ***C21D 1/20*** | (2006.01) |
| ***C22C 38/02*** | (2006.01) |
| ***C22C 38/06*** | (2006.01) |
| ***C22C 38/20*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/32*** | (2006.01) |
| *C22C 38/42* | (2006.01) |
| *C22C 38/50* | (2006.01) |
| *C22C 38/54* | (2006.01) |
| *C22C 38/58* | (2006.01) |

(56) References Cited

U.S. PATENT DOCUMENTS

| | | | | |
|---|---|---|---|---|
| 8,084,144 | B2 | 12/2011 | Hara et al. | |
| 9,181,609 | B2 | 11/2015 | Ishikawa et al. | |
| 9,200,344 | B2 | 12/2015 | Saito | |
| 9,222,155 | B2 | 12/2015 | Nakamura et al. | |
| 2010/0003535 | A1 | 1/2010 | Hara et al. | |
| 2011/0186189 | A1 | 8/2011 | Futamura | |
| 2013/0160904 | A1* | 6/2013 | Saito | C21D 6/00 148/602 |
| 2013/0167985 | A1 | 7/2013 | Saito | |
| 2013/0276940 | A1* | 10/2013 | Nakajima | C21D 8/0226 148/602 |
| 2016/0068937 | A1 | 3/2016 | Nakajima et al. | |

FOREIGN PATENT DOCUMENTS

| | | | | |
|---|---|---|---|---|
| CN | 102333899 | A | 1/2012 | |
| CN | 102918173 | A | 2/2013 | |
| CN | 103108971 | A | 5/2013 | |
| CN | 103108974 | A | 5/2013 | |
| CN | 103459645 | A | 12/2013 | |
| EP | 2559783 | A1 | 2/2013 | |
| EP | 2617853 | A1 | 7/2013 | |
| EP | 2664682 | A1 | 11/2013 | |
| EP | 2698440 | A1 | 2/2014 | |
| JP | 2001220647 | A | 8/2001 | |
| JP | 2007056294 | | 3/2007 | |
| JP | 2009280900 | A | 12/2009 | |
| JP | 2012062557 | | 3/2012 | |
| JP | 2012062561 | | 3/2012 | |
| JP | 2012251200 | | 12/2012 | |
| JP | 2012255176 | A | 12/2012 | |
| JP | 2013014844 | | 1/2013 | |
| KR | 20120001016 | A | 1/2012 | |
| KR | 20130037226 | A | 4/2013 | |
| WO | 2008069335 | A1 | 6/2008 | |
| WO | 2011065582 | A1 | 6/2011 | |
| WO | 2012036309 | A1 | 3/2012 | |
| WO | WO-2012036307 | A1 * | 3/2012 | C21D 6/00 |
| WO | WO-2012036312 | A1 * | 3/2012 | C21D 8/0226 |
| WO | 2013042239 | A1 | 3/2013 | |
| WO | 2014171062 | | 10/2014 | |
| WO | 2014171063 | | 10/2014 | |

OTHER PUBLICATIONS

Chinese Office Action for Chinese Application No. 2015800108470, dated May 19, 2017, Search Report—12 Pages.

European Communication for European Application No. 15 754 845.4, dated Jan. 16, 2018, 5 pages.

Korean Office Action for Korean Application No. 10-2016-7026523, dated Sep. 15, 2017, 5 pages.

Non Final Office Action for U.S. Appl. No. 13/820,660, dated May 4, 2016, 9 pages.

Final Office Action for U.S. Appl. No. 13/820,660, dated Dec. 15, 2016, 11 pages.

Non Final Office Action for U.S. Appl. No. 13/820,660, dated Feb. 22, 2018, 18 pages.

Final Office Action for U.S. Appl. No. 13/820,660, dated Oct. 12, 2018, 9 pages.

Non Final Office Action for U.S. Appl. No. 14/784,455, dated Jan. 8, 2018, 4 pages.

Final Office Action for U.S. Appl. No. 14/784,455, dated Jul. 13, 2018, 13 pages.

* cited by examiner

HIGH-STRENGTH HOT-ROLLED STEEL SHEET AND METHOD FOR MANUFACTURING THE SAME

CROSS-REFERENCE TO RELATED APPLICATIONS

This is the U.S. National Phase application of PCT/JP2015/000729, filed Feb. 17, 2015 and claims priority to Japanese Patent Application No. 2014-036569, filed Feb. 27, 2014, the disclosures of each of these applications being incorporated herein by reference in their entireties for all purposes.

FIELD OF THE INVENTION

The present invention relates to a high-strength hot-rolled steel sheet having a tensile strength of 980 MPa or more which can preferably be used as a material for, for example, the structural members, skeleton members, and chassis such as suspensions of automobiles, the frame parts of trucks, and steel pipes and to a method for manufacturing the steel sheet.

BACKGROUND OF THE INVENTION

Nowadays, automobile exhaust gas regulations are being strengthened from the viewpoint of global environment conservation. In addition, increasing the fuel efficiency of automobiles is a major issue, and there is a growing demand for the strengthening and thickness reduction of materials used. In such a situation, there is a trend toward actively using high-strength hot-rolled steel sheets as materials for automobile parts. High-strength hot-rolled steel sheets are used not only for, for example, the structural members and skeleton members of automobiles but also for chassis of automobiles and the frame parts of trucks.

In addition, in response to, for example, a significant increase in the price of crude oil and a demand for the diversification of sources of energy supply, there is a growing trend toward drilling oil wells or natural gas wells and constructing pipelines in very cold areas such as Russia, Canada, and Alaska. In such a situation, since there is a growing demand for further decreasing the construction costs of pipelines, there is a demand for decreasing the material costs of steel pipes. Therefore, there is a trend toward using high-strength welded steel pipes, which are manufactured from hot-rolled steel sheets having a coil shape with increased productivity and decreased cost, as transporting pipes instead of UOE steel pipes, which are manufactured from thick steel plates.

As described above, the demand for high-strength hot-rolled steel sheets having a specified strength as materials for automobile parts and steel pipes is growing year by year. In particular, a high-strength hot-rolled steel sheet having a tensile strength of 980 MPa or more is highly expected to be a material which can markedly increase the fuel efficiency of automobiles or significantly decrease the construction costs of pipelines.

Generally, however, an increase in the strength of a steel sheet may result in a decrease in toughness and punching workability. In particular, in the case of truck frame members having a large thickness where punching is performed many times, a steel sheet having excellent punching workability and toughness is required. Therefore, various investigations have been conducted in order to provide excellent punching workability and toughness to a high-strength hot-rolled steel sheet.

For example, Patent Literature 1 discloses a hot-rolled steel sheet having a thickness of 4.0 mm or more and 12 mm or less, the steel sheet having a chemical composition containing, by mass %, C: 0.04% to 0.12%, Si: 0.5% to 1.2%, Mn: 1.0% to 1.8%, P: 0.03% or less, S: 0.0030% or less, Al: 0.005% to 0.20%, N: 0.005% or less, Ti: 0.03% to 0.13%, and the balance being Fe and inevitable impurities, a microstructure including more than 95% of a bainite phase in terms of area ratio, in which the average grain diameter of the bainite phase is 3 μm or less, a difference in Vickers hardness of 50 or less between positions located at 50 μm from the surface layer and at ¼ of the thickness, and a difference in Vickers hardness of 40 or less between positions located at ¼ of the thickness and at ½ of the thickness. In addition, it is said that, according to the technique disclosed in Patent Literature 1, by forming a bainite phase having a small grain diameter as a main phase, and by decreasing a variation in hardness in the thickness direction, it is possible to obtain a high-strength hot-rolled steel sheet having a tensile strength of 780 MPa or more and excellent toughness.

In addition, Patent Literature 2 discloses a method for manufacturing a steel sheet, the method including heating a steel material having a chemical composition containing, by mass %, C: 0.05% to 0.18%, Si: 0.10% to 0.60%, Mn: 0.90% to 2.0%, P: 0.025% or less (excluding 0%), S: 0.015% or less (excluding 0%), Al: 0.001% to 0.1%, N: 0.002% to 0.01%, and the balance being Fe and inevitable impurities to a temperature of 950° C. or higher and 1250° C. or lower, then starting rolling, then finishing rolling at a temperature of 820° C. or higher, then performing cooling at a cooling rate of 20° C./s or more to a temperature in the range of 600° C. to 700° C., then holding and/or slowly cooling the cooled steel sheet in the temperature range for 10 seconds to 200 seconds, then cooling the steel sheet to a temperature of 300° C. or lower at a cooling rate of 5° C./s or more, in order to form a metallographic structure including, by an occupancy ratio with respect to the whole microstructure, 70% to 90% of ferrite, 3% to 15% of martensite or a dual phase of martensite and austenite, and the balance being bainite (including 0%), in which the average grain diameter of the ferrite is 20 μm or less. In addition, it is said that, according to the technique disclosed in Patent Literature 2, by forming a metallographic structure including ferrite having a small grain diameter, martensite or a dual phase of martensite and austenite, and so forth, it is possible to obtain a high-toughness steel material having a tensile strength of 490 $N/mm^2$ or more and a low yield ratio of 70% or less.

In addition, Patent Literature 3 discloses a thick high-strength steel plate having excellent low-temperature toughness, the steel plate having a chemical composition containing, by mass %, C: 0.02% to 0.25%, Si: 1.0% or less, Mn: 0.3% to 2.3%, P: 0.03% or less, S: 0.03% or less, Al: 0.1% or less, Nb: 0.03% to 0.25%, Ti: 0.001% to 0.10%, and the balance being Fe and inevitable impurities, in which the relationship $(Ti+Nb/2)/C<4$ is satisfied, a microstructure at a position located at 1 mm in the thickness direction from the surface being a single phase of bainite or bainitic ferrite, in which the ratio of the length of grain boundary cementite to the total length of the grain boundaries is 10% or less, and a thickness of the steel plate is 8.7 mm to 35.4 mm.

PATENT LITERATURE

PTL 1: Japanese Unexamined Patent Application Publication No. 2012-062557

PTL 2: Japanese Unexamined Patent Application Publication No. 2007-056294

PTL 3: Japanese Unexamined Patent Application Publication No. 2013-014844

SUMMARY OF THE INVENTION

In the case of the technique disclosed in Patent Literature 1, since no consideration is given to the state in which Fe-based carbides are precipitated in a bainite structure, there is a case where it is not possible to provide sufficient punching workability to a steel sheet. In addition, when a hot-rolled steel sheet is manufactured, in order to form a desired microstructure it is necessary to cool a finish-rolled steel sheet by performing two-step cooling in which the cooling rates of the two steps are different from each other, and therefore there is a problem in that it is difficult to manufacture the steel sheet.

In the case of the technique disclosed in Patent Literature 2, since the steel material has a metallographic structure including mainly a ferrite phase while having a tensile strength of 980 MPa grade, there may be a significant decrease in the toughness of a ferrite phase.

In the case of the technique disclosed in Patent Literature 3, although the amount of grain boundary cementite is controlled in order to increase low-temperature toughness, the strength of the hot-rolled steel sheet is insufficient. Since the tensile strength is about 800 MPa at most as indicated in the examples in the DESCRIPTION, and since it is difficult to stably achieve a high strength corresponding to a tensile strength of 980 MPa or more, there is a problem in that the strength of a steel sheet is insufficient.

An object of aspects of the present invention is, by solving the problems described above, to provide a high-strength hot-rolled steel sheet excellent in terms of punching workability and toughness and a method for manufacturing the steel sheet.

The present inventors, in order to achieve the object described above, diligently conducted investigations to increase the punching workability and toughness of a hot-rolled steel sheet while maintaining a high tensile strength of 980 MPa or more. Specifically, the present inventors, focusing on a bainite phase, which is generally known to have a good strength-toughness balance, diligently conducted investigations regarding a method for achieving good punching workability while maintaining a strength-toughness balance, and, as a result, found that it is very effective for increasing the strength, toughness, and punching workability of a hot-rolled steel sheet to decrease the bainite grain diameter and control the spacing between Fe-based carbides precipitated in bainite grains. In addition, from the results of additional investigations, it was found that, by adding C, Mn, Cr, and B in a well-balanced manner, by forming a microstructure including a bainite phase as a main phase in an amount of more than 90% in terms of area ratio, by controlling the average grain diameter of the bainite phase to be 2.5 μm or less, and by controlling the spacing between Fe-based carbides precipitated in bainite grains to be 600 nm or less, there is a significant increase in punching workability and toughness while maintaining a high strength corresponding to a tensile strength TS of 980 MPa or more.

Aspects of the present invention have been completed on the basis of the knowledge described above, and the subject matter of aspects of the present invention is as follows.

[1] A high-strength hot-rolled steel sheet having a chemical composition containing, by mass %, C: 0.060% or more and 0.140% or less, Si: 1.00% or less, Mn: 1.30% or more and 2.50% or less, P: 0.030% or less, S: 0.0050% or less, Al: 0.070% or less, N: 0.010% or less, Ti: 0.060% or more and 0.140% or less, Cr: 0.10% or more and 0.50% or less, B: 0.0002% or more and 0.0020% or less, and the balance being Fe and inevitable impurities, in which C, Mn, Cr, and B satisfy relational expression (1) below, and a microstructure including a bainite phase as a main phase in an amount of more than 90% in terms of area ratio and, optionally, one, two, or all of a ferrite phase, a martensite phase, and a retained austenite phase as second phases in an amount of less than 10% in total in terms of area ratio, in which the average grain diameter of the bainite phase is 2.5 μm or less, in which the spacing between Fe-based carbides precipitated in bainitic ferrite grains in the bainite phase is 600 nm or less, and in which a tensile strength TS is 980 MPa or more.

$$5.0 \leq 18C+Mn+1.3Cr+1500B \leq 6.0 \quad (1)$$

(C, Mn, Cr, and B respectively denote the contents (mass %) of C, Mn, Cr, and B)

[2] The high-strength hot-rolled steel sheet according to item [1] above, the steel sheet having the chemical composition further containing, by mass %, one, two, or more selected from among V: 0.05% or more and 0.50% or less, Nb: 0.005% or more and 0.100% or less, Cu: 0.01% or more and 0.40% or less, Ni: 0.01% or more and 0.40% or less, and Mo: 0.01% or more and 0.40% or less.

[3] The high-strength hot-rolled steel sheet according to item [1] or [2] above, the steel sheet having the chemical composition further containing, by mass %, one or both selected from Ca: 0.0002% or more and 0.0055% or less and REM: 0.0002% or more and 0.0100% or less.

[4] A method for manufacturing the high-strength hot-rolled steel sheet according to any one of items [1] to [3] above, the method including heating a steel material to a temperature of 1150° C. or higher, performing rough rolling, performing finish rolling with a finish rolling start temperature of 950° C. or higher and 1130° C. or lower, a cumulative rolling reduction in the last three finish rolling passes of 40% or more, and a finishing delivery temperature of 830° C. or higher and 950° C. or lower, starting cooling within 3.0 seconds after finish rolling has been performed, performing cooling at an average cooling rate of 20° C./s or more, and performing coiling at a coiling temperature of 350° C. or higher and 500° C. or lower.

Here, in the present description, % used when describing the chemical composition of steel always refers to mass %.

In addition, in the present invention, "high-strength hot-rolled steel sheet" refers to a hot-rolled steel sheet having a tensile strength (TS) of 980 MPa or more.

According to aspects of the present invention, it is possible to obtain a high-strength hot-rolled steel sheet having a tensile strength of 980 MPa or more and excellent in terms of punching workability and toughness. In addition, it is possible to stably manufacture such a high-strength hot-rolled steel sheet.

Therefore, by using the high-strength hot-rolled steel sheet according to aspects of the present invention for, for example, the structural members and skeleton members of automobiles or the frame members of trucks, it is possible to decrease the weight of the automobile bodies while maintaining the safety of the automobiles, and thus it is possible to decrease environmental loads.

In addition, by using, instead of UOE steel pipes which are manufactured from a thick steel plate, welded steel pipes which are manufactured from the high-strength hot-rolled steel sheet according to aspects of the present invention as transporting pipes, there is an increase in productivity, which results in a further decrease in cost. As described above, aspects of the present invention have a marked effect on the industry.

DETAILED DESCRIPTION OF EMBODIMENTS OF THE INVENTION

Hereafter, exemplary embodiments of the present invention will be specifically described.

First, the reasons for the limitations on the chemical composition of the high-strength hot-rolled steel sheet according to aspects of the present invention will be described. Here, % used below when describing a chemical composition refers to mass %, unless otherwise noted.

C: 0.060% or More and 0.140% or Less

C is a chemical element which is indispensable for increasing the strength of steel, for promoting the formation of bainite, and for forming Fe-based carbides, which increase punching workability. Therefore, in accordance with aspects of the present invention, it is necessary that the C content be 0.060% or more, preferably 0.070% or more, or more preferably 0.080% or more. On the other hand, in the case where the C content is more than 0.140%, since it is difficult to control the formation of bainite, there is an increase in the amount of hard martensite formed, which results in a decrease in the toughness of a hot-rolled steel sheet. Therefore, the C content is set to be 0.060% or more and 0.140% or less. It is preferable that the C content be 0.130% or less, or more preferably 0.120% or Less.

Si: 1.00% or Less

Si is a chemical element which inhibits the formation of oxides and cementite having a large grain diameter which decrease toughness, and contributes to solid solution strengthening. However, in the case where the Si content is more than 1.00%, the precipitation of Fe-based carbides, which increase punching workability, is obstructed. Moreover, since there is a significant decrease in the surface quality of a hot-rolled steel sheet, there is a decrease in phosphatability and corrosion resistance. Therefore, the Si content is set to be 1.00% or less, preferably 0.90% or less, or more preferably 0.80% or less. Although there is no particular limitation on the lower limit of the Si content, it is preferable that the lower limit be 0.20% or more.

Mn: 1.30% or More and 2.50% or Less

Mn is a chemical element which contributes to an increase in the strength of steel by forming a solid solution, increases hardenability, promotes the formation of bainite, and promotes the precipitation of Fe-based carbides in bainite grains. In order to realize such effects, it is necessary that the Mn content be 1.30% or more. On the other hand, in the case where the Mn content is more than 2.50%, since central segregation becomes marked, a hard martensite phase is formed in the central portion in the thickness direction, which results in a decrease in the punching workability and toughness of a hot-rolled steel sheet. Therefore, the Mn content is set to be 1.30% or more and 2.50% or less. It is preferable that the lower limit of the Mn content be 1.50% or more, or more preferably 1.70% or more. It is preferable that the upper limit of the Mn content be 2.20% or less, or more preferably 2.00% or less.

P: 0.030% or Less

P is a chemical element which contributes to an increase in the strength of steel by forming a solid solution. However, P is also a chemical element which causes a decrease in low-temperature toughness and workability as a result of being segregated at grain boundaries, in particular, prior austenite grain boundaries. Therefore, it is preferable that the P content be as small as possible. However, it is acceptable that the P content be 0.030% or less. Therefore, the P content is set to be 0.030% or less. However, in the case where the P content is decreased more than necessary, it is not possible to realize an effect corresponding to an increase in refining costs. It is preferable that the P content be 0.003% or more and 0.030% or less, or more preferably 0.005% or more and 0.020% or less.

S: 0.0050% or Less

S decreases the punching workability of a hot-rolled steel sheet as a result of combining with Ti and Mn to form sulfides having a large grain diameter. Therefore, it is preferable that the S content be as small as possible. However, it is acceptable that the S content be 0.0050% or less. Therefore, the S content is set to be 0.0050% or less. It is, from the viewpoint of punching workability, preferable that the 0.0040% or less, or more preferably 0.0020% or less. However, in the case where the S content is decreased more than necessary, it is not possible to realize an effect corresponding to an increase in refining costs. Therefore, it is preferable that the S content be 0.0003% or more, or more preferably 0.0005% or more.

Al: 0.070% or Less

Al is a chemical element which is effective for increasing the cleanliness of steel by functioning as a deoxidation agent. On the other hand, in the case where the Al content is excessively large, there is an increase in the amount of oxide-based inclusions, which results in a decrease in the toughness of a hot-rolled steel sheet and results in flaws occurring. Therefore, the Al content is set to be 0.070% or less, preferably 0.005% or more and 0.060% or less, or more preferably 0.010% or more and 0.050% or less.

N: 0.010% or Less

N contributes to a decrease in grain diameter by combining with nitride-forming chemical elements to form nitride precipitates. However, since N tends to combine with Ti to form nitrides having a large grain diameter at a high temperature, there is a decrease in the punching workability of a hot-rolled steel sheet. Therefore, the N content is set to be 0.010% or less, preferably 0.001% or more and 0.008% or less, or more preferably 0.002% or more and 0.006% or less.

Ti: 0.060% or More and 0.140% or Less

Ti increases the toughness of a hot-rolled steel sheet by decreasing grain diameter as a result of forming carbonitrides. In addition, Ti contributes to an increase in the strength of steel through precipitation strengthening. In order to realize such effects, it is necessary that the Ti content be 0.060% or more. On the other hand, in the case where the Ti content is more than 0.140%, the effects described above become saturated, and there is a decrease in the toughness of a hot-rolled steel sheet due to an increase in the amount of precipitates having a large grain diameter. Therefore, the Ti content is set to be 0.060% or more and 0.140% or less. It is preferable that the lower limit of the Ti content be 0.080% or more, or more preferably 0.090% or more. It is preferable that the upper limit of the Ti content be 0.130% or less, or more preferably 0.120% or less.

Cr: 0.10% or More and 0.50% or Less

Cr is a chemical element which contributes to an increase in the strength of a hot-rolled steel sheet by forming carbides, increases hardenability, promotes the formation of bainite, and promotes the precipitation of Fe-based carbides in bainite grains. In order to realize such effects, the Cr content is set to be 0.10% or more. On the other hand, in the case where the Cr content is more than 0.50%, there is a decrease in toughness, and there may be a decrease in the corrosion resistance of a hot-rolled steel sheet. Therefore, the Cr content is set to be 0.10% or more and 0.50% or less. It is preferable that the lower limit of the Cr content be 0.15% or more, or more preferably 0.20% or more. It is preferable that the upper limit of the Cr content be 0.45% or less, or more preferably 0.40% or less.

B: 0.0002% or More and 0.0020% or Less

B is a chemical element which inhibits the formation and growth of ferrite by being segregated at austenite grain boundaries. Also, B is a chemical element which increases hardenability, contributes to the formation of a bainite phase and to a decrease in the grain diameter of a bainite phase, and promotes the precipitation of Fe-based carbides in bainite grains. In order to realize such effects, the B content is set to be 0.0002% or more. However, in the case where the B content is more than 0.0020%, the formation of a martensite phase is promoted and there is a significant decrease in the punching workability and toughness of a hot-rolled steel sheet. Therefore, the B content is set to be 0.0002% or more and 0.0020% or less. It is preferable that the lower limit of the B content be 0.0004% or more, or more preferably 0.0006% or more. It is preferable that the upper limit of the B content be 0.0016% or less, or more preferably 0.0014% or less.

In accordance with aspects of the present invention, the contents of C, Mn, Cr, and B are controlled to be within the ranges described above so that relational expression (1) below is satisfied.

$$5.0 \leq 18C+Mn+1.3Cr+1500B \leq 6.0 \quad (1)$$

(C, Mn, Cr, and B respectively denote the contents (mass %) of C, Mn, Cr, and B)

C, Mn, Cr, and B are, as described above, chemical elements which increase hardenability, promote the formation of bainite, and promote the precipitation of Fe-based carbides in bainite grains. However, unless these chemical elements are added in a well-balanced manner, it is not possible to form the desired microstructure. In the case where (18C+Mn+1.3Cr+1500B) is less than 5.0, since it is not possible to achieve sufficient hardenability, it is not possible to precipitate a sufficient amount of Fe-based carbides in bainite grains, which increase punching workability. In addition, in the case where (18C+Mn+1.3Cr+1500B) is more than 6.0, since the formation of a martensite phase is promoted due to excessive hardenability, there is a significant decrease in the punching workability and toughness of a hot-rolled steel sheet. Therefore, in accordance with aspects of the present invention, the contents of C, Mn, Cr, and B are controlled so that relational expression (1) is satisfied. Accordingly, it is possible to obtain a hot-rolled steel sheet having excellent punching workability and a high toughness.

In accordance with aspects of the present invention, the remaining constituent chemical elements other than those described above are Fe and inevitable impurities. Examples of inevitable impurities include Sb, Sn, and Zn, and it is acceptable that the Sb content be 0.01% or less, the Sn content be 0.1% or less, and the Zn content be 0.01% or less.

Although the basic chemical composition of the high-strength hot-rolled steel sheet according to aspects of the present invention is as described above, one, two, or more selected from among V: 0.05% or more and 0.50% or less, Nb: 0.005% or more and 0.100% or less, Cu: 0.01% or more and 0.40% or less, Ni: 0.01% or more and 0.40% or less, and Mo: 0.01% or more and 0.40% or less may be added to the high-strength hot-rolled steel sheet according to aspects of the present invention as needed, for example, in order to increase toughness or strength.

V: 0.05% or More and 0.50% or Less

V increases the toughness of a hot-rolled steel sheet by decreasing grain diameter as a result of forming carbonitrides. Also, V contributes to an increase in the strength of steel through precipitation strengthening. In order to realize such effects, it is preferable that the V content be 0.05% or more. On the other hand, in the case where the V content is more than 0.50%, the effects described above become saturated, and there may be an increase in cost. Therefore, in the case where V is added, the V content is set to be 0.05% or more and 0.50% or less, preferably 0.08% or more and 0.40% or less, or more preferably 0.10% or more and 0.30% or less.

Nb: 0.005% or More and 0.100% or Less

Nb is a chemical element which contributes to an increase in the strength of steel by forming carbonitrides. In order to realize such an effect, it is preferable that the Nb content be 0.005% or more. On the other hand, in the case where the Nb content is more than 0.100%, because of an increase in resistance to deformation, an excessively high load may be placed on a rolling mill due to an increase in rolling load of hot rolling when a hot-rolled steel sheet is manufactured, there is concern that a rolling operation may be difficult. In addition, in the case where the Nb content is more than 0.100%, there is a tendency for the toughness of a hot-rolled steel sheet to decrease as a result of the formation of precipitates having a large grain diameter. Therefore, in the case where Nb is added, the Nb content is set to be 0.005% or more and 0.100% or less, preferably 0.010% or more and 0.080% or less, or more preferably 0.020% or more and 0.060% or less.

Cu: 0.01% or More and 0.40% or Less

Cu is a chemical element which contributes to an increase in the strength of steel by forming a solid solution. Also, Cu is a chemical element which has a function of increasing hardenability, contributes to a decrease in the grain diameter of a bainite phase particularly by lowering the bainite transformation temperature, and promotes the precipitation of Fe-based carbides in bainite grains. In order to realize such effects, it is preferable that the Cu content be 0.01% or more. However, in the case where the Cu content is more than 0.40%, there is a decrease in the surface quality of a hot-rolled steel sheet. Therefore, in the case where Cu is added, the Cu content is set to be 0.01% or more and 0.40% or less, or preferably 0.02% or more and 0.30% or less.

Ni: 0.01% or More and 0.40% or Less

Ni is a chemical element which contributes to an increase in the strength of steel by forming a solid solution. Also, Ni is a chemical element which has a function of increasing hardenability, facilitate the formation of a bainite phase, and promote the precipitation of Fe-based carbides in bainite grains. In order to realize such effects, it is preferable that the Ni content be 0.01% or more. However, in the case where the Ni content is more than 0.40%, since a martensite phase tends to be formed, there may be a significant decrease in the punching workability and toughness of a hot-rolled steel sheet. Therefore, in the case where Ni is added, the Ni content is set to be 0.01% or more and 0.40% or less, or preferably 0.02% or more and 0.30% or less.

Mo: 0.01% or More and 0.40% or Less

Mo is a chemical element which promotes the formation of a bainite phase by increasing hardenability and promotes the precipitation of Fe-based carbides in bainite grains. In order to realize such effects, it is preferable that the Mo content be 0.01% or more. However, in the case where the Mo content is more than 0.40%, a martensite phase Lends to be formed, and there may be a decrease in the punching workability and toughness of a hot-rolled steel sheet. Therefore, in the case where Mo is added, the Mo content is set to be 0.01% or more and 0.40% or less, or preferably 0.02% or more and 0.30% or less.

In addition, one or both selected from Ca: 0.0002% or more and 0.0055% or less and REM: 0.0002% or more and 0.0100% or less may be added to the high-strength hot-rolled steel sheet according to aspects of the present invention as needed.

Ca: 0.0002% or More and 0.0055% or Less

Ca is effective for increasing the punching workability and toughness of a hot-rolled steel sheet by controlling the shape of sulfide-based inclusions. In order to realize such effects, it is preferable that the Ca content be 0.0002% or more. However, in the case where the Ca content is more than 0.0055%, surface defects may occur in a hot-rolled steel sheet. Therefore, in the case where Ca is added, the Ca content is set to be 0.0002% or more and 0.0055% or less, preferably 0.0002% or more and 0.0050% or less, or more preferably 0.0004% or more and 0.0030% or less.

REM: 0.0002% or More and 0.0100% or Less

REM, like Ca, decreases the negative effect of sulfide-based inclusions on the punching workability and toughness of a hot-rolled steel sheet by controlling the shape of sulfide-based inclusions. In order to realize such effects, it is preferable that the REM content be 0.0002% or more. However, in the case where the REM content is excessive and more than 0.0100%, since there is a decrease in the cleanliness of steel, there is a tendency for the toughness of a hot-rolled steel sheet to decrease. Therefore, in the case where REM is added, the REM content is set to be 0.0002% or more and 0.0100% or less, or preferably 0.0004% or more and 0.0050% or less.

Hereafter, the reasons for the limitation on the microstructure of the high-strength hot-rolled steel sheet according to aspects of the present invention will be described.

The high-strength hot-rolled steel sheet according to aspects of the present invention has a microstructure including a bainite phase as a main phase in an amount of more than 90% in terms of area ratio. Moreover, optionally, one, two, or all of a ferrite phase, a martensite phase, and a retained austenite phase as second phases are included in an amount of less than 10% in total in terms of area ratio. In addition, the average grain diameter of the bainite phase is 2.5 m or less, and the spacing between Fe-based carbides precipitated in bainitic ferrite grains in the bainite phase is 600 nm or less.

Bainite Phase: More than 90% in Terms of Area Ratio and the Average Grain Diameter of the Bainite Phase: 2.5 μm or Less The high-strength hot-rolled steel sheet according to aspects of the present invention has a microstructure including a bainite phase as a main phase. "Bainite phase" refers to a microstructure including a bainitic ferrite having a lath-like shape and Fe-based carbides existing between the bainitic ferrite grains and/or in the bainitic ferrite grains (including a case where no Fe-based carbide is precipitated). Since bainitic ferrite, unlike polygonal ferrite, has a lath-like shape and a comparatively high dislocation density therein, bainitic ferrite is easy to identify by using a SEM (scanning electron microscope) or a TEM (transmission electron microscope). In the case where the amount of a bainite phase is more than 90% and the average grain diameter of the bainite phase is 2.5 m or less, it is possible to achieve the desired toughness. In the case where the amount of a bainite phase is 90% or less or the average grain diameter of the bainite phase is more than 2.5 μm, it is not possible to achieve the desired toughness. Therefore, the amount of a bainite phase is set to be more than 90%, preferably 92% or more, or more preferably 95% or more, in terms of area ratio. It is even more preferable that the amount of a bainite phase be 100% in terms of area ratio so as to form a bainite single phase structure. The average grain diameter of the bainite phase is set to be 2.5 μm or less, preferably 2.3 μm or less, or more preferably 2.0 μm or less.

One, Two or all of a Ferrite Phase, a Martensite Phase, and a Retained Austenite Phase (Second Phase): Less than 10% in Terms of Area Ratio The high-strength hot-rolled steel sheet according to aspects of the present invention may have a microstructure including, in addition to a bainite phase which is a main phase, one, two or all of a ferrite phase, a martensite phase, and a retained austenite phase as second phases. In order to obtain a hot-rolled steel sheet having the desired strength and toughness, it is preferable that the microstructure be a bainite single phase structure. However, even in the case where one, two or all of a ferrite phase, a martensite phase, and a retained austenite phase are included as second phases, it is acceptable that the amount of these phases be less than 10% in total in terms of area ratio. Therefore, the total amount of the second phases described above is set to be less than 10%, preferably 8% or less, or more preferably 5% or less, in terms of area ratio.

Spacing Between Fe-Based Carbides Precipitated in Bainitic Ferrite Grains: 600 nm or Less Controlling Fe-based carbides precipitated in bainitic ferrite grains in a bainite phase, which is a main phase, is important for increasing punching workability. In the case where the spacing between Fe-based carbides precipitated in bainitic ferrite grains is more than 600 nm, it is not possible to achieve the desired excellent punching workability. Therefore, the spacing between Fe-based carbides precipitated in bainitic ferrite grains is set to be 600 nm or less, preferably 500 nm or less, or more preferably 400 nm or less.

Here, it is possible to determine the area ratios of a bainite phase, a ferrite phase, a martensite phase, and a retained austenite phase, the average grain diameter of a bainite phase, and the spacing between Fe-based carbides described above by using the methods described in the EXAMPLES below.

Hereafter, the method for manufacturing the high-strength hot-rolled steel sheet according to aspects of the present invention will be described.

Aspects of the present invention include heating a steel material having the chemical composition described above to a temperature of 1150° C. or higher, performing rough rolling, performing finish rolling with a finish rolling start temperature of 950° C. or higher and 1130° C. or lower, a cumulative rolling reduction in the last three finish rolling passes of 40% or more, and a finishing delivery temperature of 830° C. or higher and 950° C. or lower, starting cooling within 3.0 seconds after finish rolling has been performed, performing cooling at an average cooling rate of 20° C./s or more, and performing coiling at a coiling temperature of 350° C. or higher and 500° C. or lower.

The method will be described in detail hereafter.

There is no particular limitation on what method is used for manufacturing a steel material, and any of ordinary methods may be used in which molten steel having the chemical composition described above is prepared by using, for example, a converter, and then a steel material such as a slab is manufactured by using a casting method such as a continuous casting method. Here, an ingot casting-slabbing method may be used.

Heating Temperature of a Steel Material: 1150° C. or Higher

In a steel material such as a slab, most of the carbonitride-forming chemical elements such as Ti exist in the form of carbonitrides having a large grain diameter. Such precipitates, which have a large grain diameter and are non-uniformly distributed in the steel material, decrease the various properties (such as strength, punching workability, and toughness) of a hot-rolled steel sheet. Therefore, the steel material before hot rolling is performed is heated to allow such precipitates having a large grain diameter to form solid solutions. In order to allow such precipitates having a large grain diameter to sufficiently form solid solutions before hot rolling is performed, it is necessary that the heating temperature of a steel material be 1150° C. or higher. In addition, in the case where the heating temperature of a steel material is excessively high, slab defects occur, and there is a decrease in yield ratio due to scale-off. Therefore, it is preferable that the heating temperature of a steel material be 1350° C. or lower. It is more preferable that the heating temperature be 1180° C. or higher and 1300° C. or lower, or even more preferably 1200° C. or higher and 1280° C. or lower. Here, in accordance with aspects of the present invention, "temperature of a steel material" refers to the surface temperature of a steel material.

Here, although a steel material is heated to a heating temperature of 1150° C. or higher and held at the temperature for a specified time, in the case where the holding time is more than 7200 seconds, there is an increase in the amount of scale generated and, for example, biting of scale tends to occur in the subsequent hot rolling process, which results in a tendency for the surface quality of a hot-rolled steel sheet to decrease. Therefore, it is preferable that the holding time of a steel material in a temperature range of 1150° C. or higher be 7200 seconds or less, or more preferably 5400 seconds or less. Although there is no particular limitation on the lower limit of the holding time, it is preferable that the lower limit of the holding time be 1800 seconds or more in order to uniformly heat a steel material.

Hot rolling is performed after a steel material has been heated. By performing rough rolling on a steel material, a sheet bar is obtained. By performing finish rolling on the sheet bar, a hot-rolled steel sheet is manufactured. There is no particular limitation on what condition is used for rough rolling as long as a sheet bar having a desired size is obtained. Finish rolling is performed after rough rolling has been performed. Here, it is preferable that descaling be performed before finish rolling is performed or between the rolling stands in the middle of finish rolling. The conditions of finish rolling are as follows. Finish rolling is started at a finish rolling start temperature of 950° C. or higher and 1130° C. or lower, the cumulative rolling reduction in the last three finish rolling passes is 40% or more, and the finishing delivery temperature is 830° C. or higher and 950° C. or lower.

Finish Rolling Start Temperature: 950° C. or Higher and 1130° C. or Lower

In the case where the finish rolling start temperature is higher than 1130° C., since it is not possible to sufficiently decrease the grain diameter of austenite, it is not possible to achieve the desired grain diameter of a bainite phase when transformation occurs. In addition, in the case where the finish rolling start temperature is lower than 950° C., since there is an excessive increase in the load placed on a rolling mill due to an increase in the rolling load of finish rolling, there is concern that a rolling operation itself may be difficult. Therefore, the finish rolling start temperature is set to be 950° C. or higher and 1130° C. or lower, preferably 970° C. or higher and 1100° C. or lower, or more preferably 1000° C. or higher and 1080° C. or lower. Here, "finish rolling start temperature" refers to the surface temperature of a steel sheet.

Cumulative Rolling Reduction in the Last Three Finish Rolling Passes: 40% or More In order to achieve the desired spacing between Fe-based carbides in bainitic ferrite grains, it is necessary that austenite in which sufficient strain is accumulated transform into bainite. Therefore, in accordance with aspects of the present invention, the cumulative rolling reduction in the last three finish rolling passes is set to be 40% or more. In the case where the cumulative rolling reduction in the last three finish rolling passes is less than 40%, since insufficient strain is accumulated in austenite, it is not possible to achieve the desired spacing between Fe-based carbides in bainitic ferrite grains after transformation has occurred. It is preferable that the cumulative rolling reduction be 45% or more, or more preferably 50% or more.

Finishing Delivery Temperature: 830° C. or Higher and 950° C. or Lower

In the case where the finishing delivery temperature is lower than 830° C., since rolling is performed in a temperature range for forming a ferrite-austenite dual phase, it is not possible to achieve the desired bainite phase fraction, which results in a decrease in the punching workability and toughness of a hot-rolled steel sheet. On the other hand, in the case where the finishing delivery temperature is higher than 950° C., the amount of strain accumulated is insufficient due to strain recovery in austenite, which results in an increase in the grain diameter of a bainite phase of a hot-rolled steel sheet obtained after transformation has occurred. As a result, since it is difficult to form the desired microstructure, there is a decrease in the toughness of a hot-rolled steel sheet. Therefore, the finishing delivery temperature is set to be 830° C. or higher and 950° C. or lower, preferably 850° C. or higher and 930° C. or lower, or more preferably 870° C. or higher and 910° C. or lower. Here, "finishing delivery temperature" refers to the surface temperature of a steel sheet.

Start of Forced Cooling: Forced Cooling is Started within 3.0 Seconds after Finish Rolling has been Performed Forced cooling is started within 3.0 seconds after finish rolling has been performed, cooling is stopped at a coiling temperature, and then the rolled steel sheet is wound in a coil shape. In the case where the time until forced cooling is started after finish rolling has been performed is more than 3.0 seconds, since the recovery of accumulated strain in austenite progresses, there is an increase in the grain diameter of a bainite phase. Accordingly, since there is an increase in the spacing between Fe-based carbides in bainitic ferrite grains, it is not possible to form the desired microstructure. As a result, it is not possible to achieve the desired punching workability and toughness. Therefore, the time until forced cooling is started after finish rolling has been performed is limited within 3.0 seconds, preferably within 2.0 seconds, or more preferably within 1.0 second.

Here, cooling method may be appropriately selected from among water cooling, air cooling, and so forth.

Average Cooling Rate: 20° C./s or More

In the case where the average cooling rate from the finishing delivery temperature to the coiling temperature is less than 20° C./s, since ferrite transformation occurs before bainite transformation, it is not possible to form the desired amount of a bainite phase in terms of area ratio. In addition, there may be an increase in the average grain diameter of a bainite phase. Therefore, the average cooling rate is set to be 20° C./s or more, or preferably 30° C./s or more. There is no particular limitation on the upper limit of the average cooling rate. However, in the case where the average cooling rate is excessively large, since martensite tends to be formed on the surface of a steel sheet due to an excessive decrease in the surface temperature, it is not possible to achieve the desired toughness. Therefore, it is preferable that the average cooling rate be 120° C./s or less. Here, "average cooling rate" refers to the average cooling rate of the surface of a steel sheet.

Coiling Temperature: 350° C. or Higher and 500° C. or Lower

In the case where the coiling temperature is lower than 350° C., a hard martensite phase is formed in the microstructure inside a steel sheet. As a result, since it is not possible to obtain a hot-rolled steel sheet having the desired microstructure, it is not possible to achieve the desired punching workability and toughness. On the other hand, in the case where the coiling temperature is higher than 500° C., there is an increase in the amount of ferrite in the microstructure inside a steel sheet. In addition, since there is a decrease in the driving force of bainite transformation, it is not possible to achieve the desired spacing between carbides in bainitic ferrite grains, which results in a decrease in the toughness and punching workability of a hot-rolled steel sheet. Therefore, the coiling temperature is set to be 350° C. or higher and 500° C. or lower, preferably 370° C. or higher and 470° C. or lower, or more preferably 390° C. or higher and 450° C. or lower. Here, "coiling Temperature" refers to the surface temperature of a steel sheet.

Here, in accordance with aspects of the present invention, in order to decrease the amount of the segregation of the constituting chemical elements of steel when continuous casting is performed, for example, electromagnetic stirring (EMS) or intentional bulging soft reduction (IBSR) may be used. By performing an electromagnetic stirring treatment, it is possible to decrease the amount of segregation as a result of forming isometric crystals in the central part in the thickness direction. In addition, in the case where intentional bulging soft reduction is performed, it is possible to decrease the amount of segregation in the central part in the thickness direction as a result of preventing molten steel flow in the non-solidified portion of a continuously cast slab. By using at least one of such treatments for decreasing the amount of segregation, it is possible to achieve a higher level of punching workability and toughness described below.

After coiling has been performed, by using an ordinary method, skin pass rolling may be performed, and pickling may be performed in order to remove scale on the surface. Optionally, a plating treatment such as galvanizing or electrogalvanizing or a chemical conversion treatment may further be performed.

EXAMPLES

By preparing molten steels having the chemical compositions given in Table 1 by using a converter, slabs (steel materials) were manufactured by using a continuous casting method. When continuous casting was performed, in the case of steels other than the case of hot-rolled steel sheet No. 6' (steel F) given in Tables 1 through 3 described below, electromagnetic stirring (EMS) was performed as a treatment for decreasing the amount of the segregation of the constituting chemical elements. Subsequently, these steel materials were subjected to hot rolling including heating under the conditions given in Table 2, rough rolling, and finish rolling under the conditions given in Table 2. After finish rolling was performed, cooling and coiling were performed under the conditions given in Table 2 to obtain hot-rolled steel sheets having the thicknesses given in Table 2. By taking test pieces from the hot-rolled steel sheets obtained as described above, microstructure observation, a tensile test, a Charpy impact test, and a punching test were performed. The methods for performing microstructure observation and various tests are as follows.

(i) Microstructure Observation

Area Ratio of Each Microstructure

By taking a test piece for a scanning electron microscope (SEM) from the hot-rolled steel sheet, by polishing a cross section in the thickness direction parallel to the rolling direction, by then exposing a microstructure by using an etching solution (3%-nital solution), and by taking three photographs each at positions located at ¼ of the thickness and ½ of the thickness (central part in the thickness direction) with a scanning electron microscope (SEM) at a magnification of 3000 times, the area ratio of each phase was determined by performing image analysis.

Average Grain Diameter of a Bainite Phase

By taking a test piece for determining the grain diameter by using an electron backscatter diffraction patterns (EBSD) method with a SEM from the hot-rolled steel sheet, by using a surface parallel to the rolling direction as an observation surface, and by using an EBSD measuring apparatus and software for analyzing crystal orientation (OIM Data Analysis Ver. 6.2), the grain diameter of a bainite phase was determined as described below. After having polished the test piece for determining the grain diameter, finish polishing was performed by using a colloidal silica solution. In addition, by using an EBSD measuring apparatus and software for analyzing crystal orientation, the orientation differences among various crystal orientations were analyzed with the acceleration voltage of an electron beam of 20 kV in an area of 2500 $\mu m^2$ or more at intervals of 0.1 μm at three positions each located at ¼ of thickness and ½ of thickness (central part in the thickness direction. By calculating the CI value (Confidence Index) of each observation position by using the analyzing software, a case where the CI value was 0.1 or less was not used for the analysis of a crystal diameter). By defining a high-angle grain boundary as the boundary between grains adjacent to each other with an orientation difference of 15° or more as a result of two-dimensional cross-section observation, by producing a grain boundary map, by drawing five line segments having a specified length each in the vertical and horizontal directions on the grain boundary map in accordance with the cutting method prescribed in JIS H 0501, and by counting the number of grains which were completely cut by the line segments, the average grain diameter of a bainite phase was defined as the average value of the cut lengths.

Spacing Between Fe-Based Carbides in Bainitic Ferrite Grains

In addition, by taking a test piece (having a size of 10 mm×15 mm) for producing a replica from a position located at ¼ of the thickness of the obtained hot-rolled steel sheet, and by producing a replica film by using a two-stage replica method, Fe-based carbides were extracted. Subsequently, by observing the extracted Fe-based carbides with a transmission electron microscope (TEM), the photographs of five fields of view were obtained (at a magnification of 50000 times). By using the obtained microstructure photographs, the average grain radius (r) of Fe-based carbides in bainitic ferrite grains was determined, the volume fraction (f) was determined by performing image analysis, and the spacing (L) between Fe-based carbides was determined by using equation (2)

$$L=r(2\pi/3f)^{(1/2)}-r \quad (2)$$

Here, Fe-based carbides were identified by using energy dispersive X-ray spectroscopy (EDX) when microstructure photographs were obtained.

(ii) Tensile Test

By taking a JIS No. 5 test piece (having a GL of 50 mm) from the hot-rolled steel sheet so that the tensile direction is at a right angle to the rolling direction, and by performing a tensile test in accordance with the prescription in JIS Z 2241 (2011), yield strength (yield point, YP), tensile strength (TS), and total elongation (El) were determined.

(iii) Punching Work Test

A blank sheet (30 mm×30 mm) was taken from the hot-rolled steel sheet. Then, by using a flat-bottomed punch having a diameter of 10 mmφ, by setting die hole diameters so that the punching clearance was 10%, 15%, 20%, 25%, and 30%, and by holding the blank sheet with a blank holder from the top, the blank sheet was punched. After punching had been performed, the state of the punched fracture surface across the whole circumference of the punched hole was observed with a microscope (at a magnification of 50 times) in order to determine whether or not, for example, cracking, chipping, a brittle fracture surface, or a secondary shear surface existed. By observing the five punched holes formed as described above, punching workability was evaluated in such a manner that the case of five punched holes without, for example, cracking, chipping, a brittle fracture surface, or a secondary shear surface was judged as ◎ (satisfactory), the case of three or four punched holes without, for example, cracking, chipping, a brittle fracture surface, or a secondary shear surface was judged as ○ (satisfactory), and the other cases (the cases of two to zero punched holes without, for example, cracking, chipping, a brittle fracture surface, or a secondary shear surface) were judged as x (unsatisfactory).

(iv) Charpy Impact Test

By taking a subsize test piece (having a V notch) whose thickness was the thickness of the hot-rolled steel sheet from the hot-rolled steel sheet so that the longitudinal direction of the test piece was at a right angle to the rolling direction, by performing a Charpy impact test in accordance with the prescription in JIS Z 2242, and by determining ductile-brittle fracture transition temperature (vTrs), toughness was evaluated. A case where the determined vTrs was −60° C. or lower was judged as the case of good toughness.

The results obtained as described above are given in Table 3.

TABLE 1

| | Chemical Composition (mass %) Balance: Fe and Inevitable Impurities | | | | | | | | | | | |
|---|---|---|---|---|---|---|---|---|---|---|---|---|
| Steel | C | Si | Mn | P | S | Al | N | Ti | Cr | B | V | Nb |
| A | 0.040 | 0.85 | 1.89 | 0.024 | 0.0029 | 0.009 | 0.0065 | 0.163 | 0.43 | 0.0009 | — | — |
| B | 0.172 | 0.65 | 1.68 | 0.019 | 0.0014 | 0.023 | 0.0055 | 0.089 | 0.36 | 0.0006 | — | — |
| C | 0.083 | 1.42 | 1.89 | 0.025 | 0.0014 | 0.043 | 0.0049 | 0.118 | 0.25 | 0.0009 | — | — |
| D | 0.112 | 0.83 | 1.06 | 0.021 | 0.0024 | 0.050 | 0.0044 | 0.123 | 0.43 | 0.0006 | — | — |
| E | 0.093 | 0.55 | 2.92 | 0.026 | 0.0003 | 0.011 | 0.0029 | 0.114 | 0.25 | 0.0003 | — | — |
| F | 0.109 | 0.68 | 1.75 | 0.022 | 0.0033 | 0.041 | 0.0016 | 0.067 | 0.23 | 0.0007 | 015 | — |
| G | 0.094 | 0.65 | 1.82 | 0.022 | 0.0044 | 0.041 | 0.0057 | 0.112 | 0.28 | 0.0010 | — | — |
| H | 0.117 | 0.72 | 1.48 | 0.004 | 0.0033 | 0.016 | 0.0051 | 0.128 | 0.16 | 0.0014 | — | — |
| I | 0.107 | 0.62 | 1.46 | 0.013 | 0.0045 | 0.067 | 0.0029 | 0.121 | 0.20 | 0.0013 | — | — |
| J | 0.121 | 0.77 | 1.85 | 0.027 | 0.0036 | 0.042 | 0.0052 | 0.003 | 0.28 | 0.0008 | 0.19 | — |
| L | 0.115 | 0.64 | 1.87 | 0.022 | 0.0020 | 0.024 | 0.0034 | 0.111 | 0.04 | 0.0008 | — | — |
| M | 0.121 | 0.59 | 1.85 | 0.027 | 0.0004 | 0.012 | 0.0046 | 0.092 | 0.65 | 0.0007 | — | — |
| N | 0.082 | 0.74 | 1.97 | 0.005 | 0.0014 | 0.008 | 0.0051 | 0.124 | 0.55 | 0.0001 | — | — |
| O | 0.093 | 0.63 | 1.41 | 0.015 | 0.0041 | 0.039 | 0.0054 | 0.104 | 0.16 | 0.0032 | — | — |
| P | 0.126 | 0.79 | 1.75 | 0.025 | 0.0041 | 0.037 | 0.0030 | 0.085 | 0.21 | 0.0011 | — | 0.037 |
| Q | 0.110 | 0.70 | 2.29 | 0.017 | 0.0038 | 0.027 | 0.0034 | 0.105 | 0.36 | 0.0004 | — | — |
| R | 0.069 | 0.47 | 1.47 | 0.005 | 0.0008 | 0.048 | 0.0038 | 0.094 | 0.47 | 0.0013 | — | — |
| S | 0.121 | 0.82 | 1.47 | 0.012 | 0.0011 | 0.064 | 0.0044 | 0.127 | 0.31 | 0.0012 | — | — |

| | Chemical Composition (mass %) Balance: Fe and Inevitable Impurities | | | | | 18(C) + Mn + 1.3 | |
|---|---|---|---|---|---|---|---|
| Steel | Cu | Ni | Mo | Ca | REM | (Cr) + 1500(B) | Note |
| A | — | — | — | — | — | 4.52 | Comparative Steel |
| B | — | — | — | — | — | 6.15 | Comparative Steel |
| C | — | — | — | — | — | 5.06 | Comparative Steel |
| D | — | — | — | — | — | 4.53 | Comparative Steel |
| E | — | — | — | — | — | 5.36 | Comparative Steel |
| F | — | — | — | — | — | 5.06 | Example Steel |
| G | — | — | — | — | — | 5.37 | Example Steel |
| H | — | — | — | — | — | 5.90 | Example Steel |
| I | 0.22 | — | — | — | — | 5.59 | Example Steel |
| J | — | — | — | — | — | 5.60 | Comparative Steel |
| L | — | — | — | — | — | 5.21 | Comparative Steel |
| M | — | — | — | — | — | 5.92 | Comparative Steel |
| N | — | — | — | — | — | 4.30 | Comparative Steel |

TABLE 1-continued

| | | | | | | | |
|---|---|---|---|---|---|---|---|
| O | — | — | — | — | — | 8.09 | Comparative Steel |
| P | — | — | — | — | — | 5.94 | Example Steel |
| Q | 0.22 | 0.33 | — | — | — | 5.33 | Example Steel |
| R | — | — | 0.35 | — | — | 5.28 | Example Steel |
| S | — | — | — | 0.0052 | 0.0016 | 5.85 | Example Steel |

* An underlined portion indicates a value out of the range according to the present invention.

TABLE 2

| | | Hot Rolling Condition | | | | | | | | |
|---|---|---|---|---|---|---|---|---|---|---|
| Hot-Rolled Steel Sheet No. | Steel | Slab Heating Temperature (° C.) | Finish Rolling Start Temperature (° C.) | Cumulative Rolling Reduction in Last 3 Finish Rolling Passes (%) | Finishing Delivery Temperature (° C.) | Cooling Start Time1) (s) | Average Cooling Rate (° C./s) | Coiling Temperature (° C.) | Thickness (mm) | Note |
| 1 | A | 1180 | 1040 | 48 | 910 | 1.0 | 65 | 400 | 2.6 | Comparative Example |
| 2 | B | 1220 | 1090 | 53 | 935 | 1.0 | 65 | 440 | 2.6 | Comparative Example |
| 3 | C | 1240 | 1100 | 54 | 865 | 3.0 | 45 | 435 | 4.0 | Comparative Example |
| 4 | D | 1240 | 1110 | 46 | 860 | 2.5 | 90 | 365 | 2.3 | Comparative Example |
| 5 | E | 1220 | 1100 | 69 | 925 | 1.5 | 60 | 420 | 2.9 | Comparative Example |
| 6 | F | 1200 | 1100 | 66 | 870 | 0.5 | 60 | 375 | 2.9 | Example |
| 6' | F | 1200 | 1100 | 66 | 870 | 0.6 | 60 | 380 | 2.9 | Example |
| 7 | F | 1160 | 1030 | 63 | 800 | 1.5 | 110 | 380 | 2.0 | Comparative Example |
| 8 | F | 1250 | 1110 | 66 | 890 | 0.5 | 90 | 320 | 2.3 | Comparative Example |
| 9 | G | 1240 | 1100 | 51 | 935 | 2.0 | 65 | 400 | 2.6 | Example |
| 10 | G | 1240 | 1180 | 42 | 920 | 1.0 | 80 | 380 | 2.3 | Comparative Example |
| 11 | H | 1180 | 1070 | 68 | 865 | 1.0 | 80 | 405 | 2.3 | Example |
| 12 | H | 1250 | 1100 | 62 | 860 | 3.0 | 15 | 375 | 7.0 | Comparative Example |
| 13 | I | 1170 | 1020 | 50 | 930 | 1.0 | 50 | 365 | 3.6 | Example |
| 14 | I | 1230 | 1090 | 32 | 905 | 2.0 | 20 | 380 | 7.0 | Comparative Example |
| 15 | J | 1180 | 1090 | 53 | 910 | 0.5 | 60 | 375 | 3.2 | Comparative Example |
| 16 | L | 1190 | 1080 | 50 | 935 | 2.5 | 30 | 420 | 6.0 | Comparative Example |
| 17 | M | 1200 | 1090 | 61 | 865 | 1.5 | 110 | 430 | 2.0 | Comparative Example |
| 18 | N | 1160 | 1060 | 67 | 895 | 1.5 | 40 | 410 | 4.0 | Comparative Example |
| 19 | O | 1230 | 1100 | 69 | 865 | 2.5 | 30 | 400 | 6.0 | Comparative Example |
| 20 | P | 1230 | 1120 | 50 | 915 | 1.5 | 80 | 410 | 2.3 | Example |
| 21 | Q | 1180 | 1030 | 60 | 905 | 0.5 | 60 | 380 | 2.9 | Example |
| 22 | R | 1180 | 1040 | 66 | 900 | 2.5 | 55 | 430 | 2.9 | Example |
| 23 | S | 1190 | 1080 | 45 | 865 | 2.5 | 55 | 475 | 2.9 | Example |

* An underlined portion indicates a value out of the range according to the present invention.

1)Time until forcible cooling is started after finish rolling has been performed.

TABLE 3

| | | Microstructure | | | | | |
|---|---|---|---|---|---|---|---|
| Hot-Rolled Steel Sheet No. | Steel | Bainite Phase Area Ratio (%) | Martensite Phase Area Ratio (%) | Ferrite Phase Area Ratio (%) | Retained Austenite Phase Area Ratio (%) | Bainite Phase Average Grain Diameter (μm) | Spacing between Fe-based Carbides in Bainitic Ferrite Grain (nm) |
| 1 | A | 100 | 0 | 0 | 0 | 1.620 | 980 |
| 2 | B | 93 | 7 | 0 | 0 | 1.730 | 420 |
| 3 | C | 99 | 1 | 0 | 0 | 2.129 | 1420 |
| 4 | D | 87 | 0 | 13 | 0 | 1.556 | 923 |
| 5 | E | 87 | 8 | 0 | 5 | 1.675 | 380 |
| 6 | F | 100 | 0 | 0 | 0 | 1.708 | 360 |
| 6' | F | 100 | 0 | 0 | 0 | 1.750 | 380 |
| 7 | F | 94 | 0 | 6 | 0 | 1.210 | 830 |
| 8 | F | 86 | 14 | 0 | 0 | 1.750 | 180 |
| 9 | G | 98 | 2 | 0 | 0 | 1.861 | 260 |
| 10 | G | 98 | 2 | 0 | 0 | 2.780 | 290 |
| 11 | H | 98 | 2 | 0 | 0 | 1.008 | 220 |
| 12 | H | 95 | 0 | 5 | 0 | 2.781 | 1020 |
| 13 | I | 100 | 0 | 0 | 0 | 1.387 | 270 |
| 14 | I | 100 | 0 | 0 | 0 | 2.320 | 730 |
| 15 | J | 97 | 3 | 0 | 0 | 2.830 | 320 |
| 16 | L | 97 | 0 | 3 | 0 | 2.310 | 690 |
| 17 | M | 88 | 8 | 0 | 4 | 1.293 | 180 |

TABLE 3-continued

| | | | | | | | |
|---|---|---|---|---|---|---|---|
| 18 | N | 98 | 0 | 2 | 0 | 1.367 | 890 |
| 19 | O | 84 | 16 | 0 | 0 | 2.217 | 120 |
| 20 | P | 94 | 6 | 0 | 0 | 1.066 | 380 |
| 21 | Q | 92 | 8 | 0 | 0 | 1.268 | 410 |
| 22 | R | 99 | 1 | 0 | 0 | 1.298 | 360 |
| 23 | S | 95 | 5 | 0 | 0 | 1.462 | 440 |

| Hot-Rolled Steel Sheet No. | Mechanical Property of Hot-rolled Steel sheet: Yield Point YP (MPa) | Tensile Strength TS (MPa) | Total Elongation El (%) | Punching Workability | vTrs (° C.) | Note |
|---|---|---|---|---|---|---|
| 1 | 881 | 982 | 13.2 | X | −40 | Comparative Example |
| 2 | 834 | 995 | 14.3 | X | −40 | Comparative Example |
| 3 | 890 | 985 | 14.5 | X | −70 | Comparative Example |
| 4 | 841 | 1038 | 14.5 | X | −40 | Comparative Example |
| 5 | 815 | 1015 | 16.1 | X | −40 | Comparative Example |
| 6 | 917 | 1007 | 12.7 | ⊙ | −80 | Example |
| 6' | 915 | 1010 | 12.0 | ○ | −65 | Example |
| 7 | 902 | 1002 | 14.0 | X | −40 | Comparative Example |
| 8 | 829 | 1062 | 13.8 | X | −20 | Comparative Example |
| 9 | 868 | 985 | 13.5 | ⊙ | −70 | Example |
| 10 | 885 | 1005 | 12.7 | ○ | −40 | Comparative Example |
| 11 | 928 | 1031 | 12.1 | ⊙ | −120 | Example |
| 12 | 955 | 1061 | 15.5 | X | −40 | Comparative Example |
| 13 | 937 | 1042 | 12.4 | ⊙ | −100 | Example |
| 14 | 924 | 1027 | 14.3 | X | −40 | Comparative Example |
| 15 | 833 | 993 | 15.0 | ○ | −30 | Comparative Example |
| 16 | 825 | 983 | 19.9 | X | −70 | Comparative Example |
| 17 | 851 | 1040 | 14.1 | X | −50 | Comparative Example |
| 18 | 886 | 985 | 15.3 | X | −100 | Comparative Example |
| 19 | 769 | 1026 | 17.7 | X | −30 | Comparative Example |
| 20 | 885 | 1037 | 12.7 | ⊙ | −100 | Example |
| 21 | 900 | 1075 | 12.9 | ⊙ | −80 | Example |
| 22 | 869 | 987 | 14.4 | ⊙ | −100 | Example |
| 23 | 838 | 983 | 15.1 | ⊙ | −80 | Example |

* An underlined portion indicates a value out of the range according to the present invention.

It is clarified that, in the case of the examples of the present invention, hot-rolled steel sheets having the desired strength (a TS of 980 MPa or more), excellent punching workability, and excellent toughness (a vTrs of −60° C. or lower) were obtained. In addition, in the case of the hot-rolled steel sheets of the examples of the present invention, the desired strength and excellent toughness were achieved across the whole thickness, which means that hot-rolled steel sheets having good properties across the whole thickness were obtained.

On the other hand, in the case of the comparative examples, which were out of the range according aspects of to the present invention, the desired strength was not achieved, sufficient punching workability was not achieved, or sufficient toughness was not achieved.

The invention claimed is:

1. A high-strength hot-rolled steel sheet having a chemical composition containing, by mass %, C: 0.060% or more and 0.140% or less, Si: 1.00% or less, Mn: 1.30% or more and 2.50% or less, P: 0.030% or less, S: 0.0050% or less, Al: 0.070% or less, N: 0.010% or less, Ti: 0.060% or more and 0.140% or less, Cr: 0.10% or more and 0.50% or less, B: 0.0002% or more and 0.0020% or less, and the balance being Fe and inevitable impurities, in which C, Mn, Cr, and B satisfy relational expression (1) below, and a microstructure including a bainite phase as a main phase in an amount of more than 90% in terms of area ratio and one, two, or all of a ferrite phase, a martensite phase, and a retained austenite phase as second phases in an amount of less than 10% in total in terms of area ratio, wherein the average grain diameter of the bainite phase is 2.5 μm or less, wherein the spacing between Fe-based carbides precipitated in bainitic ferrite grains in the bainite phase is 600 nm or less, and wherein a tensile strength TS is 980 MPa or more:

$$5.0 \leq 18C+Mn+1.3Cr+1500B \leq 6.0 \quad (1).$$

(C, Mn, Cr, and B respectively denote the contents (mass %) of C, Mn, Cr, and B)

2. The high-strength hot-rolled steel sheet according to claim 1, the steel sheet having the chemical composition further containing, by mass %, one, two, or more selected from among V: 0.05% or more and 0.50% or less, Nb: 0.005% or more and 0.100% or less, Cu: 0.01% or more and 0.40% or less, Ni: 0.01% or more and 0.40% or less, and Mo: 0.01% or more and 0.40% or less.

3. The high-strength hot-rolled steel sheet according to claim 1, the steel sheet having the chemical composition further containing, by mass %, one or both selected from Ca: 0.0002% or more and 0.0055% or less and REM: 0.0002% or more and 0.0100% or less.

4. A method for manufacturing the high-strength hot-rolled steel sheet according to claim 1, the method comprising:

heating a steel material to a temperature of 1150° C. or higher, performing rough rolling, performing finish rolling with a finish rolling start temperature of 950° C. or higher and 1130° C. or lower, a cumulative rolling reduction in the last three finish rolling passes of 40% or more, and a finishing delivery temperature of 830° C. or higher and 950° C. or lower, starting cooling within 3.0 seconds after finish rolling has been performed, performing cooling at an average cooling rate of 20° C./s or more, and performing coiling at a coiling temperature of 350° C. or higher and 500° C. or lower.

5. The high-strength hot-rolled steel sheet according to claim 2, the steel sheet having the chemical composition further containing, by mass %, one or both selected from Ca: 0.0002% or more and 0.0055% or less and REM: 0.0002% or more and 0.0100% or less.

6. The high-strength hot-rolled steel sheet according to claim 1, wherein the steel sheet has a ductile-brittle fracture transition temperature vTrs of −60° C. or lower.

7. The high-strength hot-rolled steel sheet according to claim 1, wherein the steel sheet has a ductile-brittle fracture transition temperature vTrs of −65° C. or lower.

* * * * *